US005967842A

United States Patent [19]

Okabe

[11] Patent Number: 5,967,842

[45] Date of Patent: Oct. 19, 1999

[54] CONNECTOR HAVING INTEGRAL CONNECTING MEMBER FOR CUTTING AND FOR SUBSEQUENT PLACEMENT WITHIN RECEIVING PORTIONS

[75] Inventor: Toshiaki Okabe, Shizuoka, Japan

[73] Assignee: Yazaki Corporation, Tokyo, Japan

[21] Appl. No.: 09/055,283

[22] Filed: Apr. 6, 1998

[30] Foreign Application Priority Data

Apr. 7, 1997 [JP] Japan ..... 9-088293

[51] Int. Cl.[6] ..... H01R 13/40

[52] U.S. Cl. ..... 439/596; 439/701

[58] Field of Search ..... 439/596, 752, 439/751, 701, 686, 687, 695, 400

[56] References Cited

U.S. PATENT DOCUMENTS

| | | | |
|---|---|---|---|
| 4,200,350 | 4/1980 | Zimmerman, Jr. | 439/752 |
| 5,141,452 | 8/1992 | Yoneda et al. | 439/752 |
| 5,147,222 | 9/1992 | Hotea et al. | 439/752 |
| 5,562,495 | 10/1996 | Kakitani et al. | 439/596 |
| 5,716,235 | 2/1998 | Endo et al. | 439/596 |

FOREIGN PATENT DOCUMENTS

| | | | |
|---|---|---|---|
| 2-41824 | 11/1990 | Japan | H01R 13/42 |

*Primary Examiner*—Paula Bradley
*Assistant Examiner*—Antoine Ngandjui
*Attorney, Agent, or Firm*—Sughrue, Mion, Zinn, Macpeak & Seas, PLLC

[57] ABSTRACT

A connector is disclosed which comprises a housing including a plurality of terminal chambers formed inside of side walls and an opened space formed through to each of the terminal chambers, a cover having at least one receiving portion formed on a lower face thereof, for closing the opened space of the housing, and at least one connecting member provided for cutting, the connecting member uniformly combining an upper face of the housing with the lower face of the cover before the opened space is closed by the cover, wherein, when the opened space is closed by the cover, the receiving portion on the lower face of the cover is located so as to receive at least one piece of connecting member remaining on the upper face of the housing after cutting. The housing further includes at least one receiving portion provided on at least one of the side walls of the housing, and when the opened space is closed by the cover, the receiving portion on the side wall of the housing is located so as to receive the cut piece of the connecting member remaining on the lower face of the cover after cutting.

14 Claims, 7 Drawing Sheets

CONNECTOR HAVING INTEGRAL CONNECTING MEMBER FOR CUTTING AND FOR SUBSEQUENT PLACEMENT WITHIN RECEIVING PORTIONS

BACKGROUND OF THE INVENTION

1. Technical Field of the Invention

The present invention relates to a connector for use preferably with a wire harness in a vehicle.

2. Description of the Related Art

The following describes a conventional connector for wire harnesses, with reference to FIGS. 7 to 10. In the connector 1, a plurality of terminal chambers 3 are formed in upper and lower rows of a housing 2 made of synthetic resin. On upper and lower faces of the housing 2, opened spaces 4 are formed through to each of the chambers 3. After press-connecting terminals 6 in which electric wires 5 connected therewith are disposed, in each of the terminal chambers 3, the opened spaces 4 are respectively closed by covers 7 which are combined with terminal engaging members. The upper and lower faces of the housing 2 and the covers 7 are connected by at least one hinges 8 respectively. At the central front of the upper and lower faces of the housing 2, a connecting member is formed, respectively. The covers 7 in a state prior to closing, are rigidly connected by the connecting members 9. Thus, the connectors 1 are not entwined with each other while packing or transferring the connectors 1 in which the covers 7 are not closed, thereby avoiding breakdown of the housing 2 and the covers 7.

As shown in FIGS. 9, 10(*a*), 10(*b*) and 10(*c*), when assembling the connector 1, each of the connecting members 9 is cut, each of the covers 7 is rotated by using each of the pair of hinges 8, and each of the opened spaces 4 of the housing 2 is closed. A similar structure is disclosed in Unexamined Japanese Utility Model Publication Hei. 2-41824.

In the conventional connector 1, as described heretofore, it is necessary to cut and remove the connecting members 9 for mounting the covers 7 onto the opened spaces 4 of the housing 2. Hence, as shown in FIGS. 9 and 10(*c*), it is possible that remains 9*a* or chips 9*b* remaining from cutting the connecting members 9, cause the following problems to occur: (1) the remains 9*a* of the connecting members 9 project towards the outside of the housing 2 and the covers 7, and thus, they can cause an obstruction in engaging the connector 1 with a mating connector; (2) the possibility exists that the chips 9*b* of the connecting members 9 can trespass into the connecting portions of the press-connecting terminals 6, and thus, can cause inferior conduction.

SUMMARY OF THE INVENTION

To solve the aforementioned problems, the object of the present invention is to provide a connector in which the remains from cutting a connecting member do not project towards the outside of a housing and cannot cause an obstruction in engaging with a mating connector, and in which inferior conduction of terminals caused by chips from a cutting member can be avoided with certainty.

To achieve the above object, according to the first aspect of the present invention, there is provided a connector which comprises a housing including a plurality of terminal chambers formed inside of side walls and an opened space formed through to each of the terminal chambers, a cover having at least one receiving portion formed on a lower face thereof, for closing the opened space of the housing, and at least one connecting member provided for cutting, the connecting member uniformly combining an upper face of the housing with the lower face of the cover before the opened space is closed by the cover, wherein, when the opened space is closed by the cover, the receiving portion on the lower face of the cover is located so as to receive at least one piece of connecting member remaining on the upper face of the housing after cutting. The housing further includes at least one receiving portion provided on at least one of the side walls of the housing, and when the opened space is closed by the cover, the receiving portion on the side wall of the housing is located so as to receive the cut piece of the connecting member remaining on the lower face of the cover after cutting.

In the connector of the present invention, due to the fact that the cut pieces of the connecting members do not project toward outside of the housing, the cut pieces cannot cause an obstruction in engaging with the mating connector; and also due to the fact that the connecting members are not reduced by the cutting, chips of the connecting members cannot be formed, and an inferior conduction due to trespassing of the chips into the connecting portions of the press-connecting terminals can be avoided with certainty.

According to a second aspect of the present invention, the pair of connecting members may include two engaging members arranged in the vertical direction, each of the connecting members being dividable by cutting between the upper engaging member and the lower engaging member, the pair of upper engaging members being engaged with the pair of receiving portions on the side walls of the housing, and the pair of lower engaging members being engaged with the pair of receiving portions on the lower face of the cover.

In the connector of the present invention, in addition to the merits of the first aspect of the present invention, due to the fact that the cut pieces of the connecting members are utilized as engaging members for engaging the cover with the housing, it is not necessary to provide a separate lock mechanism, thereby downsizing of the connector, and a reduction in manufacturing costs of the connector, can be achieved.

BRIEF DESCRIPTION OF THE DRAWINGS

In the accompanying drawings:

FIG. 2(*b*) is a section view of the connector of the first embodiment showing the mounting of the covers;

FIG. 2(*c*) is a section view of the connector of the first embodiment showing a state where the mounting of the covers is completed;

FIG. 4(*b*) is a section view taken along the line A—A in FIG. 3, showing the connector in the third embodiment showing the mounting of the covers;

FIG. 4(*c*) is a section view taken along the line A—A in FIG. 3, showing the connector in the third embodiment showing a state where the mounting of the covers is completed;

FIG. 6(*b*) is a section view of the connector in the third embodiment showing the mounting of the covers;

FIG. 6(*c*) is a section view of the connector in the third embodiment showing a state where the mounting of the covers is completed;

FIG. 10(*b*) is a perspective view of the conventional connector showing the mounting of the covers; and FIG. 10(*c*) is a perspective view of the conventional connector showing a state where the mounting of the covers is completed.

DETAILED DESCRIPTION OF THE PREFERRED EMBODIMENTS

The following is a detailed description of preferred embodiments of the present invention with reference to the drawings.

Figure 1:
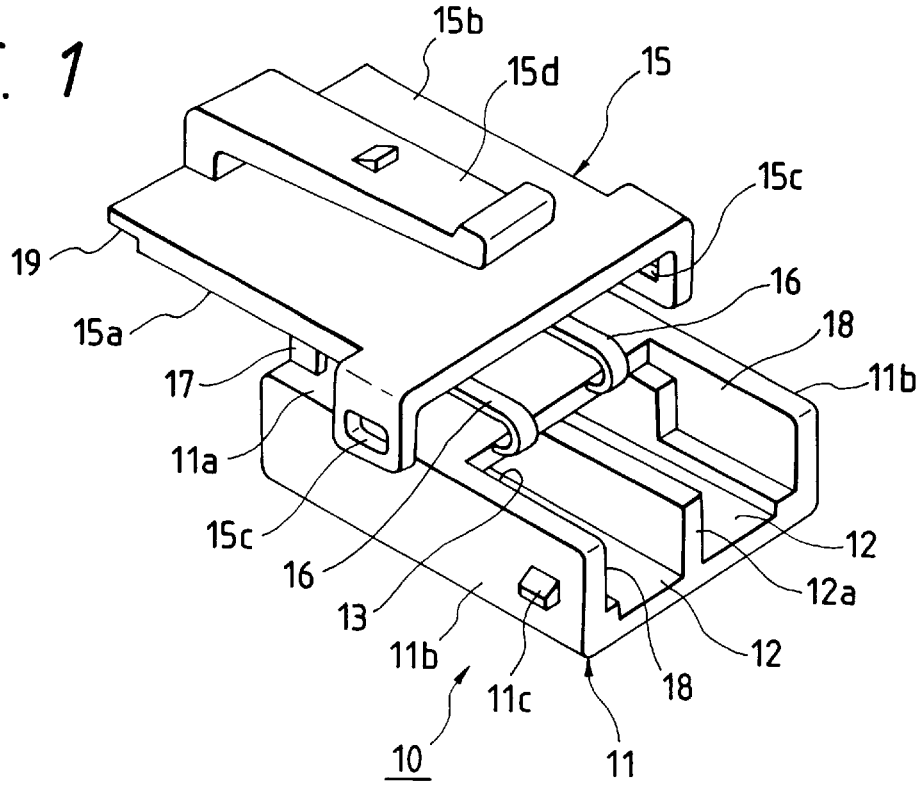
FIG. 1 is a perspective view showing a connector in the first embodiment of the present invention.
Figure 2A:
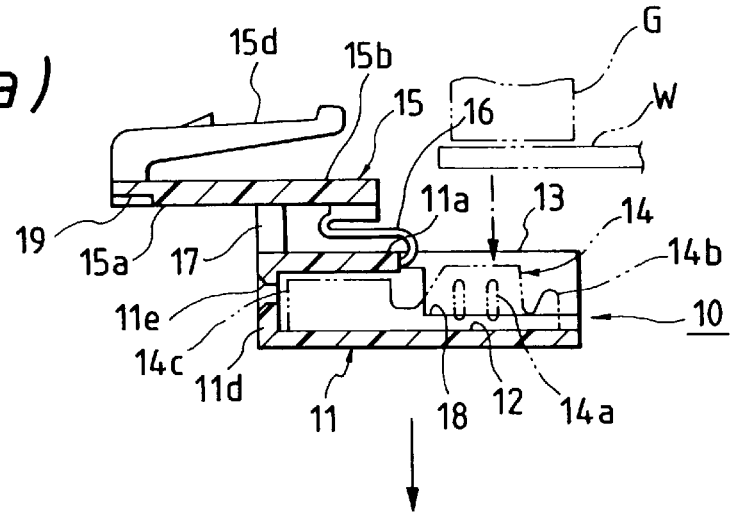
FIG. 2(*a*) is a section view of the connector in the first embodiment showing a pre-state where covers are mounted onto the opened spaces of a housing.
Figure 2B:
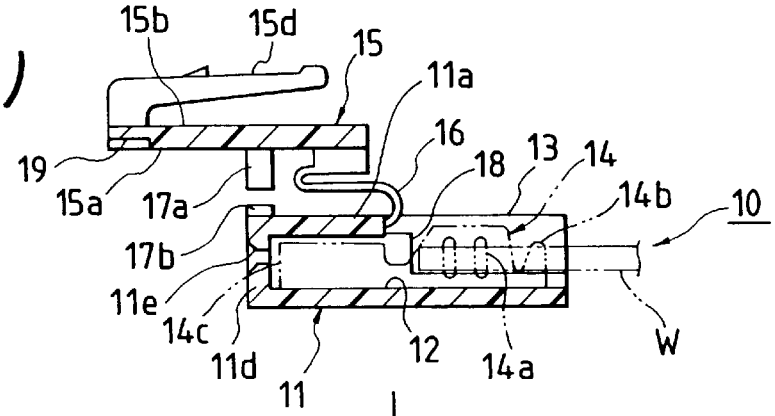
Figure 2C:
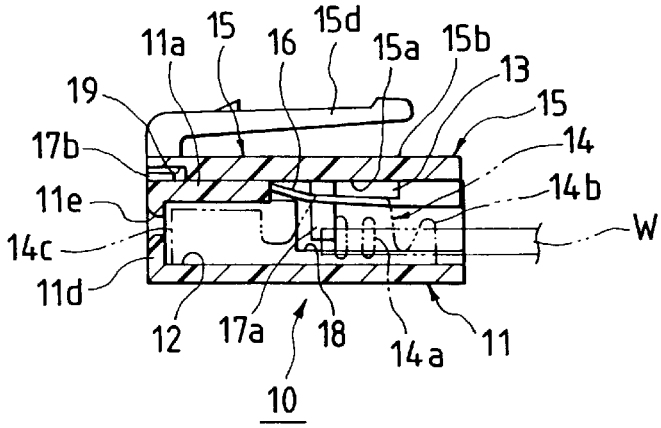

FIG. 1 is a perspective view showing a press-connecting connector of the first embodiment of the present invention which is preferable for use with, for instance, wire harnesses in a vehicle. FIGS. 2(*a*)–2(*c*) are section views showing the sequence in mounting a cover of the connector.

As shown in FIGS. 1 and 2, a connector 10 has terminal chambers 12 arranged in a horizontal row. A box-shaped housing 11 is made of synthetic resin and includes an opened space 13 formed through to each of the terminal chambers 12. Press-connecting terminals 14 are disposed in each of the terminal chambers 12 and electric wires W are press-connected thereto, respectively. A cover 15 which is combined with a terminal engaging member closes the opened space 13 so as to cover press-connecting portions 14*a*, and securing portion 14*b* of the press-connecting terminals 14 which are exposed from the opened space 13. A pair of hinges 16 is integrally formed so as to connect the rear side of the upper face 11*a* of the housing 11 with the rear side of lower face 15*a* of the cover 15. A pair of cuttable connecting members 17 is integrally formed so as to connect the front side of the upper face 11*a* of the housing 11 with the middle portion of the lower face 15*a* of the cover 15.

Engaging members 11*c* are integrally formed so as to protrude from the rear portion of the outer faces of the side walls 11*b* of the housing 11. As shown in FIGS. 2(*a*)–2(*c*), terminal insertion holes in which male terminals of a mating connector (not shown) are inserted, are formed on the front wall of the housing 11 so as to be located such that the insertion holes lie facing with each of the connecting points 14*c* of the press-connecting terminals 14 disposed within each of the terminal chambers 12. A pair of recesses 18 are formed on the rear portion of the inner face of the side walls 11*b* of the housing 11 so as to accommodate cut pieces 17*a* of the connecting members 17 protruding from the cover 15, the cut pieces 17*a* being accommodated within the recesses 18 when the cover 15 is mounted onto the opened space 13 to close the opened space 13. Further, each of the terminal chambers 12 is restricted by a partition wall 12*a*.

Both sides of the rear portion of the cover 15 project downwards, and engaging holes 15*c* are respectively formed thereon so as to engage with each of the engaging members 11*c* of the side walls 11*b*. An L-shaped lock arm 15*d* engaging with the mating connector (not shown) is integrally formed, so as to protrude from the upper face 15*b* of the cover 15. Further, a pair of recesses 19 are formed on both sides of the front portion of the lower face 15*a* of the cover 15 so as to accommodate cut pieces 17*b* of the connecting members 17 protruding from the housing 11, the cut pieces 17*b* being accommodated within the recesses 19 when the cover 15 is mounted onto the opened space 13 to close the opened space 23.

A pair of hinges 16 is long, belt-like, elastic deformable, and integrally formed between the housing 11 and the cover 15 so as to connect them. As shown in FIG. 2(*a*), before closing the cover 15, the pair of hinges 16 is bending-deformed and accommodated within a space between the upper face 11*a* of the housing 11 and the lower face 15*a* of the cover 15. On the other hand, the pair of connecting members 17 is integrally formed so as to connect the housing 11 and the cover 15 rigidly. The connecting members 17 are rectangular, plate-like, and projectingly provided between the upper face 11*a* of the housing 11 and the lower face 15*a* of the cover 15. The faces which are not exposed to the outside are connected by the pair of the connecting members 17.

When the cover 15 is mounted onto the opened space 13 of the housing 11, each of the connecting members 17 is cut into two parts by predetermined means, one set of cut pieces 17*a* remaining on the cover 15 and the other set of cut pieces 17*b* remaining on the housing 11. Further, as shown in FIG. 2(*a*), the electric wires W are press-connected to the press-connection portions 14*a* of the press-connecting terminals 14 disposed within the terminal chambers 12 of the housing 11 through press-connecting jigs G.

According to the connector 10 of this embodiment, as shown in FIGS. 1 and 2(*a*), the cover 15 and the housing 11 are rigidly connected by the pair of connecting members 17 formed integrally therewith before the cover 15 is mounted onto the opened space 13 of the housing 11, such that breakdown of the housing 11 and the cover 15 at the time of packing or transferring of the connectors 10 can be avoided because the connectors 10 cannot be entwined with each other.

And as shown in FIGS. 2(*b*) and 2(*c*), when the cover 15 is mounted on the opened space 13 of the housing 11 to close the opened space 13, cutting the pair of connecting members 17 respectively, the cover 15 is slid in parallel to the housing 11 by using the pair of hinges 16 to close the opened space 13 of the housing 11, and the connector 10 assembly is completed. At that time, as shown in FIG. 2(*c*), the cut pieces 17*a* on the cover 15 are accommodated within the recesses 18 of the housing 11, and the cut pieces 17*b* are accommodated within the recesses 19 of the cover 15, respectively.

As described above, the pairs of recesses 18 and 19 are formed and located at a predetermined position such that the pairs of recesses 18 and 19 can respectively accommodate the cut pieces 17*a* on the cover 15 and the cut pieces 17*b* on the housing 11 when the cover 15 is closed. Hence, the cut pieces 17*a* on the cover 15 and the cut pieces 17*b* on the housing 11 do not project towards the outside of the housing 11, and thereby cannot cause an obstruction in engaging with the mating connector. Also, the connecting members are not reduced by cutting like the conventional connector, thus, chips of the connecting members 17 cannot be formed. Hence, an inferior conduction due to trespassing of the chips into the connecting portions 14*c* of the press-connecting terminal 14 cannot occur.

Figure 3:
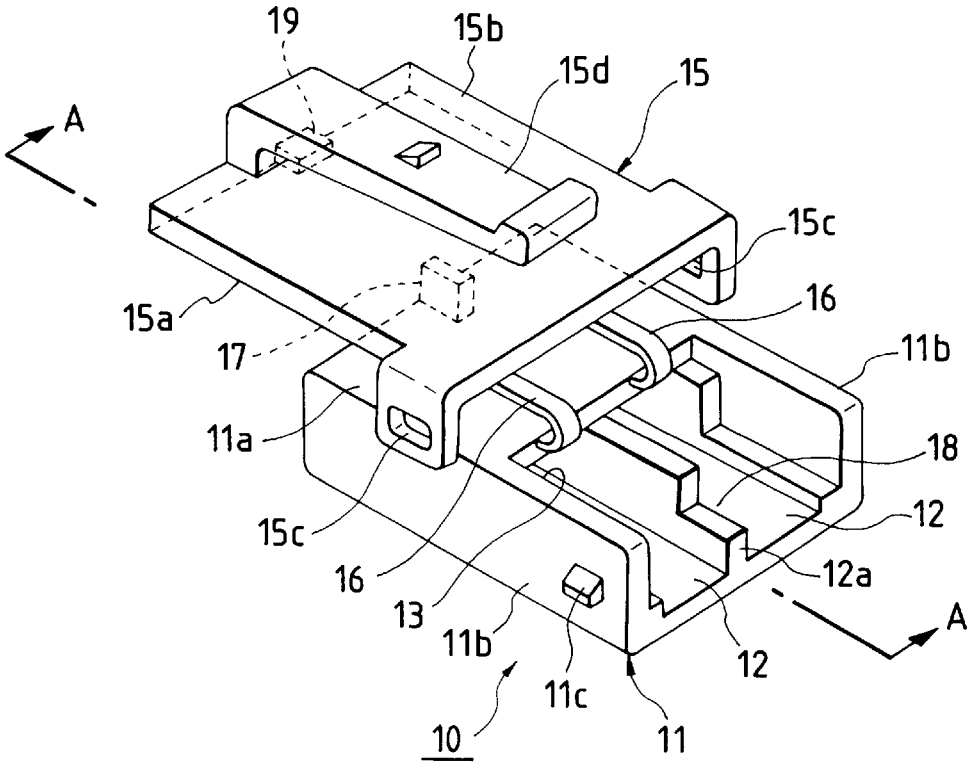
FIG. 3 is a perspective view showing a connector in the second embodiment of the present invention.
Figure 4A:
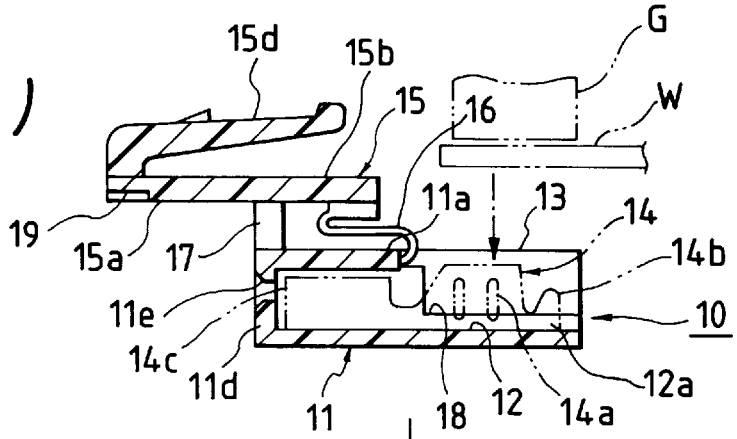
FIG. 4(*a*) is a section view taken along the line A—A in FIG. 3, showing the connector in the third embodiment showing a pre-state where the covers are mounted onto the opened spaces of a housing.
Figure 4B:
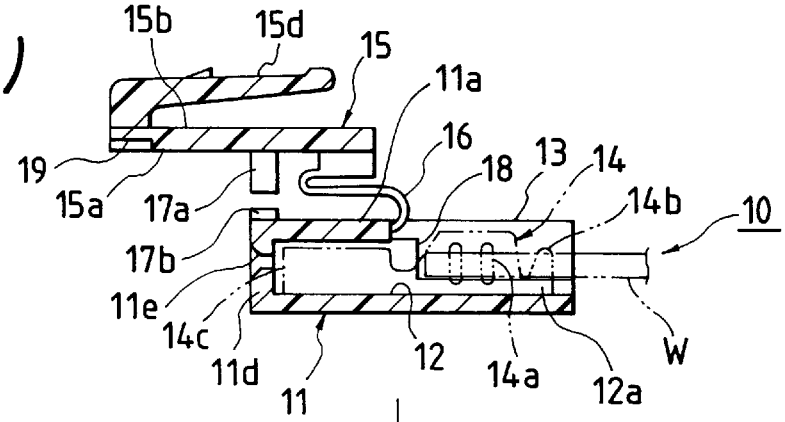
Figure 4C:
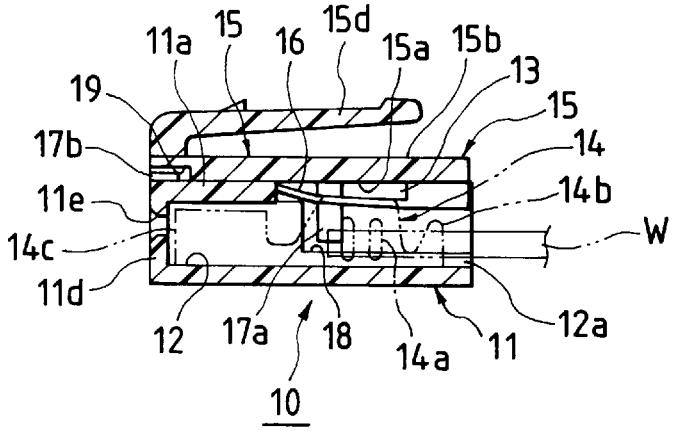

As shown in FIGS. 3 and 4, according to the second embodiment of the present invention, the connector 10 may be constituted that only one connecting member 17 is provided, and a cut piece 17*a* on the lower face 15*a* of the cover 15 and a cut piece 17*b* on the upper face 11*a* of the housing 11 are respectively accommodated within a recess 18 formed on the partition wall 12*a* and a recess 19 formed on the center of the front portion of the lower face 15*a* of the cover 15.

Figure 5:
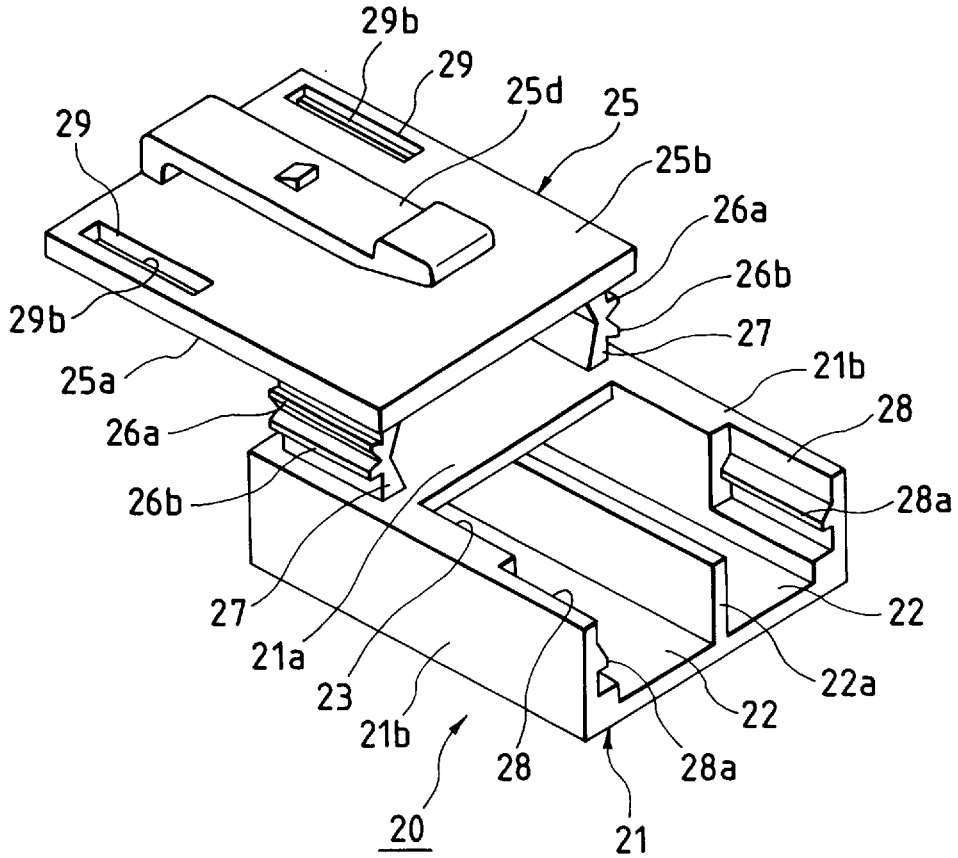
FIG. 5 is a perspective view showing a connector in the third embodiment of the present invention.
Figure 7:
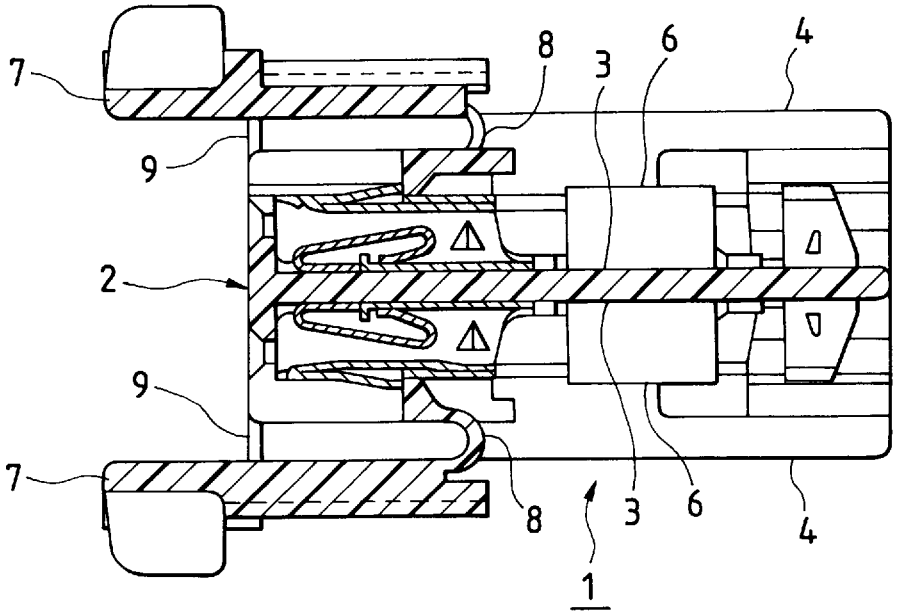
FIG. 7 is a section view of a conventional connector showing a pre-state where covers are mounted onto opened spaces of a housing.
Figure 6A:
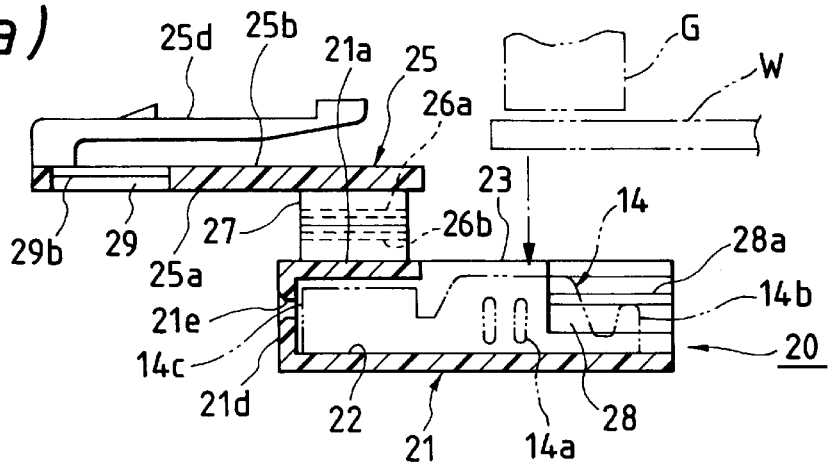
FIG. 6(*a*) is a section view of the connector in the third embodiment showing a pre-state where the covers are mounted onto the opened spaces of a housing.
Figure 6B:
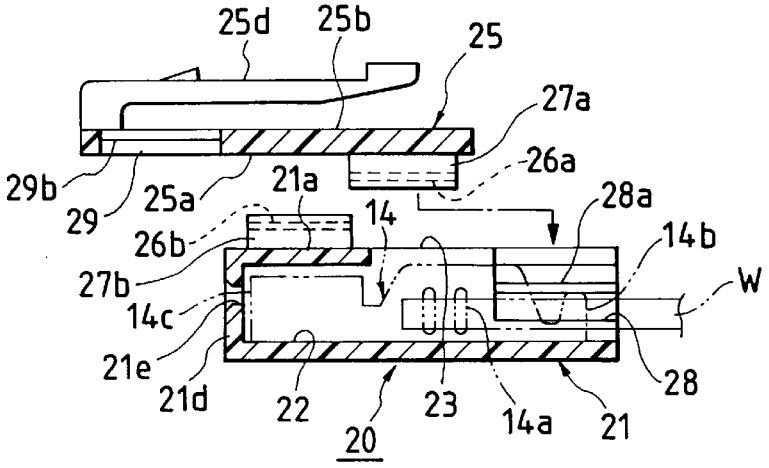
Figure 6C:
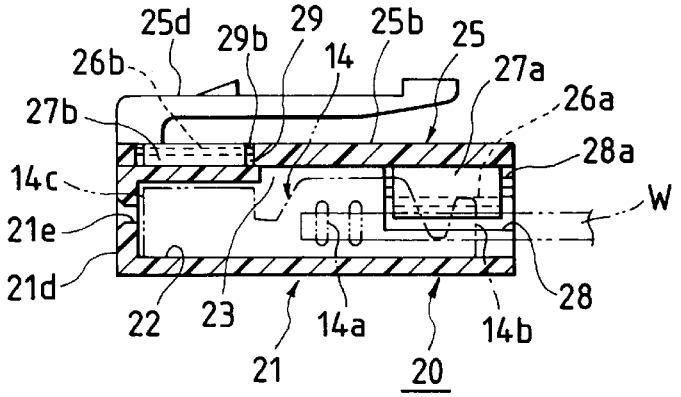
Figure 8:
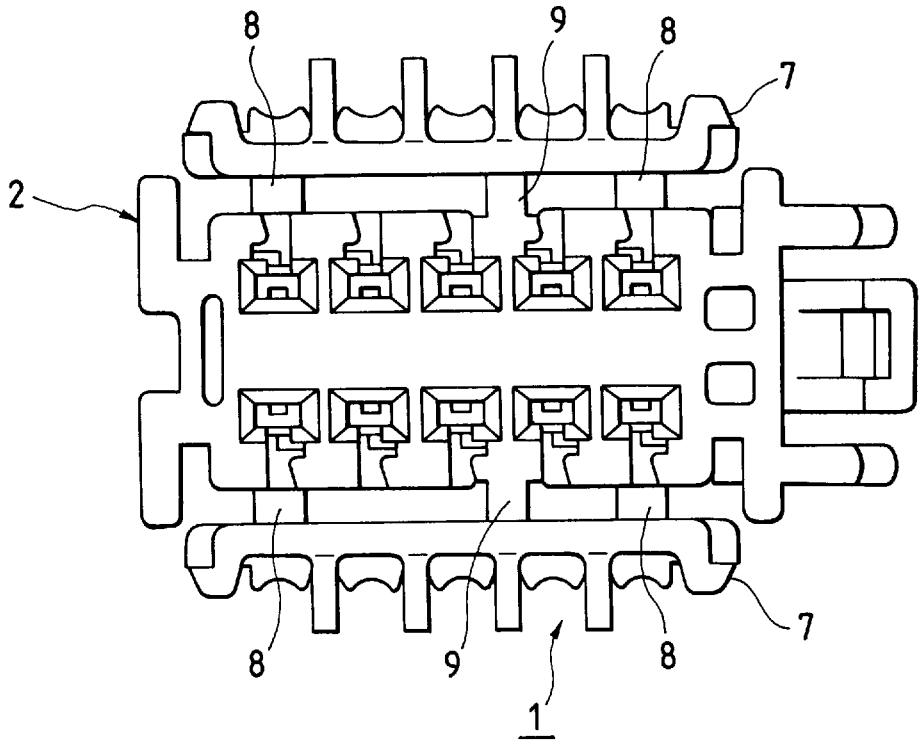
FIG. 8 is an elevation of a conventional connector showing a pre-state where covers are mounted onto the opened spaces of a housing.
Figure 9:
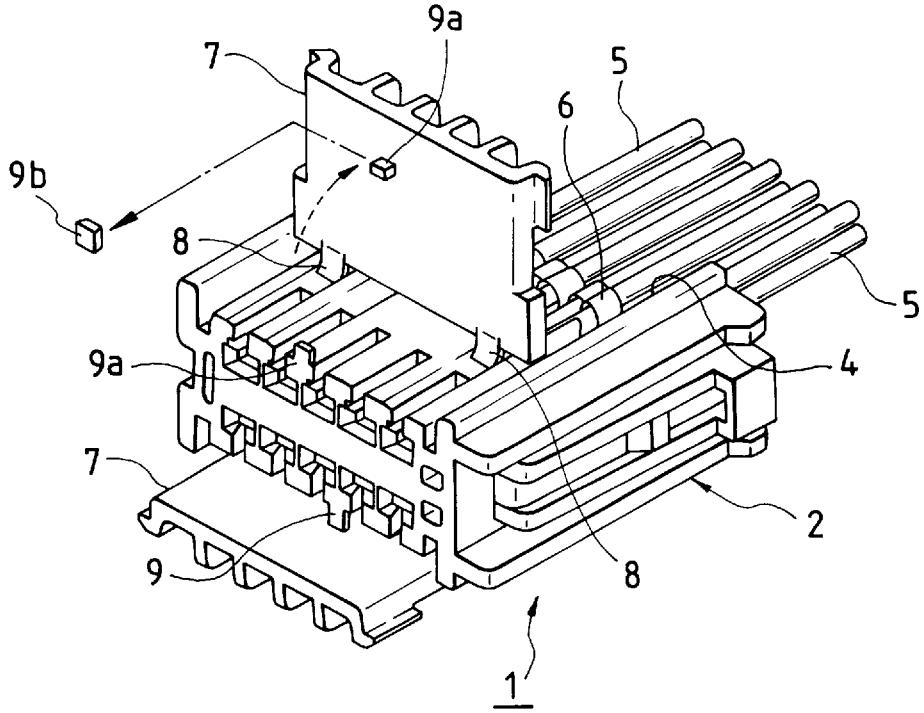
FIG. 9 is a perspective view of the conventional connector showing the mounting of the covers.
Figure 10A:
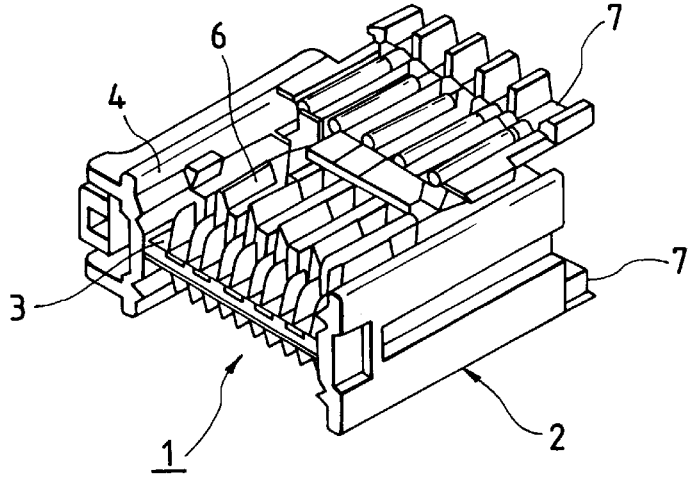
FIG. 10(*a*) is a perspective view of a conventional connector showing a pre-state where covers are mounted onto opened spaces of a housing.
Figure 10B:
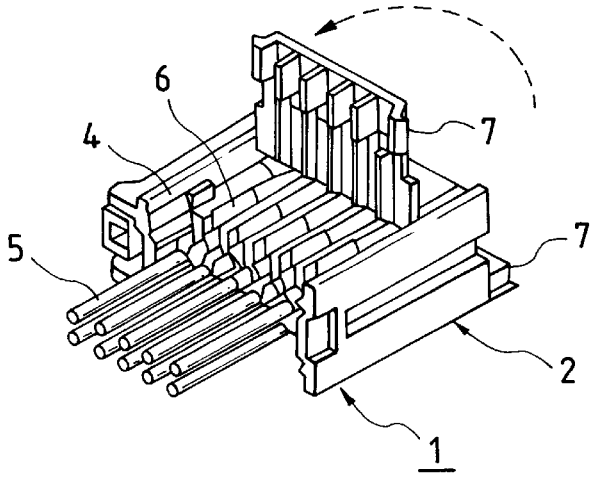
Figure 10C:
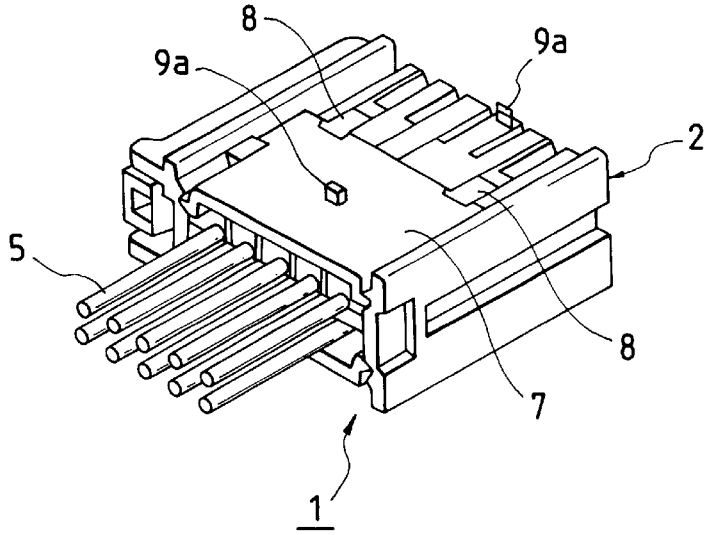

FIG. 5 is a perspective view showing a press-connecting connector of the third embodiment of the present invention which is preferable for use with, for instance, wire harnesses in a vehicle. FIGS. 6(*a*)–6(*c*) are section views showing the sequence of mounting a cover of the connector. In FIGS. 5–6(*c*), like reference numerals denote like structural elements.

As shown in FIGS. 5 and 6, a connector 20 has terminal chambers 22 arranged in a horizontal row. A box-shaped housing 21 is made of synthetic resin and includes an opened space 23 formed through to each of the terminal chambers 22. Press-connecting terminals 14 are disposed in each of the terminal chambers 22 and electric wires W are press-connected thereto respectively. A cover 25 which is combined with a terminal engaging member closes the opened space 23 so as to cover the press-connecting portions 14*a* and the securing portion 14*b* of the press-connecting terminals 14 which are exposed from the opened space 23. A pair of connecting members 27 having two beak-like engaging members 26*a* and 26*b*, which are arranged in the vertical direction and respectively, towards the outside of the connecting members 27, is integrally formed so as to connect the front side of the upper face 21*a* of the housing 21 with the middle portion of the inner face 25*a* of the cover 25. The pair of connecting members 27 can be cut respectively at between the upper engaging members 26*a* and the lower engaging members 26*b*.

As shown in FIG. 5, the terminal chambers 22 are formed between side walls 21*b* of the housing 21. Further, as shown in FIGS. 4(*a*)–4(*c*), terminal insertion holes 21*e*, in which male terminals of a mating connector (not shown) are inserted, are formed on the front wall 21*d* of the housing 21 so as to be located such that the insertion holes 21*e* are facing with each of connecting points 14*c* of the press-connecting terminals 14 disposed within each of the terminal chambers 22. A pair of hollowed engaging portions 28 are formed on the rear portion of the inner face of the side walls 21*b* of the housing 21 so as to engage with the upper engaging members 26*a* of cut pieces 27*a* of the connecting members 27 protruding from the cover 25, the upper engaging members 26*a* of the cut pieces 27*a* being engaged with engaging projections 28*a* provided on the engaging portions 28 when the cover 25 is mounted onto the opened space 23 to close the opened space 23. Further, each of the terminal chambers 22 is restricted by a partition wall 22*a*.

An L-shaped lock arm 25*d* engaging with the mating connector (not shown) is integrally formed so as to protrude from the outer face 25*b* of the cover 25. Further, a pair of rectangular engaging holes 29 are formed on both sides of the front portion of the inner face 25*a* of the cover 25 so as to engage with the lower engaging members 26*b* of the cut pieces 27*b* of the connecting members 27 protruding from the housing 21, the lower engaging members 26*b* of the cut pieces 27*b* being engaged with engaging projections 29*b* provided on inner faces of the engaging holes 29 when the cover 25 is mounted onto the opened space 23 to close the opened space 23.

As shown in FIG. 5, the pair of connecting members 27 is integrally formed so as to connect the housing 11 and the cover 15 rigidly. The connecting members 27 are projectingly provided between the upper face 21*a* of the housing 21 and the inner face 25*a* of the cover 25. The faces which are not exposed to the outside are connected by the pair of the connecting members 27. Outer faces of the connecting members 27 project outward like beaks. When the cover 25 is mounted onto the opened space 23 of the housing 21, each of the connecting members 27 is cut into two parts at between the upper engaging members 26*a* and the lower engaging members 26*b*, one set of cut pieces 27*a* with the upper engaging members 26*a* remaining on the cover 25 and the other set of cut pieces 27*b* with the lower engaging members 26*b* remaining on the housing 21. Thereby, when the cover 25 is closed, the cut pieces 27*a* on the cover 25 are utilized for engaging with the engaging projections 28*a* of the engaging portions 28, and the cut pieces 27*b* on the housing 21 are utilized for engaging the housing 21 with the engaging projections 29*b* of the engaging holes 29, respectively.

According to the connector 20 in this embodiment, as shown in FIGS. 5 and 6(*a*), the cover 25 and the housing 21 are rigidly connected by the pair of connecting members 27 formed integrally therewith before the cover 25 is mounted onto the opened space 23 of the housing 21. Thus, breakdown of the housing 21 and the cover 25 at the time of packing or transferring of the connectors 20 can be avoided because the connectors 20 cannot be entwined with each other.

As shown in FIGS. 6(*b*), and 6(*c*), when the cover 25 is mounted on the opened space 23 of the housing 21 to close the opened space 23, cutting the pair of connecting members 27 respectively, the cover 25 is slid in parallel to the housing 21 to close the opened space 23 of the housing 21, and then the connector 20 assembly is completed. At that time, as shown in FIG. 6(*c*), the cut pieces 27*a* on the cover 25 are engaged with the engaging projections 28*a* of the engaging portions 28 of the housing 21, and the cut pieces 27*b* are engaged with the engaging projections 29*b* of the engaging holes 29 of the cover 25, respectively.

As described above, the engaging portions 28 and the engaging holes 29 are formed and located at a predetermined position such that the engaging projections 28*a* and the engaging projections 29*b* can respectively engage with the cut pieces 27*a* on the cover 25 and the cut pieces 27*b* on the housing 21 when the cover 25 is closed. Hence, the cut pieces 27*a* on the cover 25 and the cut pieces 27*b* on the housing 21 do not project towards the outside of the housing 21, and thereby, cannot cause an obstruction in engaging with the mating connector. Also, the connecting members are not reduced by cutting like the conventional connector, thus, chips of the connecting members 27 cannot be formed. Hence, an inferior conduction due to the trespassing of the chips into connecting portions 14*c* of the press-connecting terminal 14 cannot occur. Further, due to fact that the cut pieces 27*a* on the cover 25 can be utilized for engaging with the engaging projections 28*a* of the engaging portions 28 and the cut pieces 27*b* on the housing 21 can be utilized for engaging the housing 21 with the engaging projections 29*b* of the engaging holes 29, it is not necessary to provide separate lock members, thereby downsizing the connector, and a reduction in manufacturing costs of the connector can be achieved.

According to the above embodiments, a connector having two terminal chambers arranged in the horizontal direction is described. The scope and spirit of the present invention can be applied to the connector having a plurality of terminal chambers arranged in the vertical direction, or a connector having a plurality of terminal chambers wherein rows of the terminal chambers arranged in the horizontal direction are plurally laminated.

As has been described heretofore, according to the first aspect of the present invention, due to the fact that the cut pieces of the connecting members do not project toward the outside of the housing, the cut pieces cannot cause an obstruction in engaging with the mating connector. Also, due to the fact that the connecting members are not reduced by cutting, chips of the connecting members cannot be formed, thereby, an inferior conduction due to the trespassing of the chips into the connecting portions of the press-connecting terminals can be avoided with certainty.

According to the second aspect of the present invention, in addition to the merits of the first aspect of the present invention, due to the fact that the cut pieces of the connecting members are utilized as engaging members for engaging the cover with the housing, it is not necessary to provide a separate lock mechanism, thereby downsizing the connector, and a reduction in manufacturing cost of the connector can be achieved.

It is contemplated that numerous modifications may be made to the apparatus of the present invention without departing from the spirit and scope of the invention as defined in the following claims.

What is claimed is:

1. A connector comprising:

a housing including a plurality of terminal chambers formed inside of side walls and an opened space formed through to each of the terminal chambers;

a cover having at least one receiving portion formed on a lower face thereof, for closing the opened space of the housing; and at least one connecting member provided for cutting, the connecting member uniformly combining an upper face of the housing with the lower face of the cover before the opened space is closed by the cover;

wherein, when the opened space is closed by the cover, the receiving portion on the lower face of the cover is located so as to receive at least one piece of connecting member remaining on the upper face of the housing after cutting.

2. The connector as set forth in claim 1, wherein the housing further comprises:

at least one receiving portion provided on at least one of the side walls of the housing, and when the opened space is closed by the cover, the receiving portion on the side wall of the housing is located so as to receive the cut piece of the connecting member remaining on the lower face of the cover after cutting.

3. The connector as set forth in claim 1, wherein the receiving portion on the lower face of the cover is a recess which can accommodate the cut piece of the connecting member remaining on the upper face of the housing.

4. The connector as set forth in claim 2, wherein the receiving portion on the side wall of the housing is a recess which can accommodate the cut piece of the connecting member remaining on the lower face of the cover.

5. The connector as set forth in claim 1, wherein the connecting member can be divided into a connecting member remaining on the lower face of the cover, and a piece of the connecting member remaining on the upper face of the housing, and an engaging member is provided on each of the pieces of the connecting members.

6. The connector as set forth in claim 5, wherein the receiving portion on the lower face of the cover has a projection engaging with the engaging member on the cut piece of the connecting member remaining on the upper face of the housing.

7. The connector as set forth in claim 5, wherein the housing further comprises:

at least one receiving portion having an engaging projection and provided on at least one of the side walls of the housing, and when the opened space is closed by the cover, the engaging projection on the side wall of the housing is located so as to engage with the engaging member on the cut piece of the connecting member remaining on the lower face of the cover after cutting.

8. A connector comprising:

a housing including a plurality of terminal chambers formed inside of side walls, an opened space formed through to each of the terminal chambers, and at least one receiving portion formed on at least one of the side walls;

a cover closing the opened space of the housing; and at least one connecting member provided for cutting, the connecting member uniformly combining an upper face of the housing with the lower face of the cover before the opened space is closed by the cover;

wherein, when the opened space is closed by the cover, the receiving portion on the side wall of the housing is located so as to receive at least one cut piece of the connecting member remaining on the lower face of the cover after cutting.

9. The connector as set forth in claim 8, wherein the cover further comprises:

at least one receiving portion provided on the lower face thereof, and when the opened space is closed by the cover, the receiving portion on the lower face of the cover is located so as to receive at least one piece of the connecting member remaining on the upper face of the housing after cutting.

10. The connector as set forth in claim 8, wherein the receiving portion on the side wall of the housing is a recess which can accommodate the cut piece of the connecting member remaining on the lower face of the cover.

11. The connector as set forth in claim 9, wherein the receiving portion on the lower face of the cover is a recess which can accommodate the cut piece of the connecting member remaining on the upper face of the housing.

12. The connector as set forth in claim 8, wherein the connecting member can be divided into a piece of connecting member remaining on the lower face of the cover and a piece of the connecting member remaining on the upper face of the housing, and an engaging member is provided on each of the pieces of the connecting members.

13. The connector as set forth in claim 12, wherein the receiving portion on the side wall of the housing has a projection engaging with the engaging member on the cut piece of the connecting member remaining on the lower face of the cover.

14. The connector as set forth in claim 12, wherein the cover further comprises:

at least one receiving portion having an engaging projection and provided on the lower face thereof, and when the opened space is closed by the cover, the engaging projection on the lower face of the cover is located so as to engage with the engaging member on the cut piece of the connecting member remaining on the upper face of the housing after cutting.

* * * * *